US007360808B2

(12) United States Patent
Odahara et al.

(10) Patent No.: US 7,360,808 B2
(45) Date of Patent: Apr. 22, 2008

(54) HANDLE APPARATUS FOR VEHICLE DOOR

(75) Inventors: Jun Odahara, Yamanashi (JP); Hiroyuki Sakagami, Yamanashi (JP)

(73) Assignee: Mitsui Mining & Smelting Co., Ltd., Tokyo (JP)

( * ) Notice: Subject to any disclaimer, the term of this patent is extended or adjusted under 35 U.S.C. 154(b) by 120 days.

(21) Appl. No.: 11/049,890

(22) Filed: Feb. 4, 2005

(65) Prior Publication Data

US 2005/0218666 A1 Oct. 6, 2005

(30) Foreign Application Priority Data

Mar. 30, 2004 (JP) ..... 2004-099775

(51) Int. Cl.
*E05B 3/00* (2006.01)

(52) U.S. Cl. ..... 292/336.3; 292/347

(58) Field of Classification Search ..... 292/336.3, 292/347

See application file for complete search history.

(56) References Cited

U.S. PATENT DOCUMENTS 4,838,590 A * 6/1989 Isomura ..... 292/336.3
5,011,202 A * 4/1991 Kato et al. ..... 292/336.3
5,794,994 A * 8/1998 Miyagawa et al. ..... 292/336.3
6,036,244 A * 3/2000 Tyves et al. ..... 292/336.3

FOREIGN PATENT DOCUMENTS

EP 0 375 275 * 6/1990
JP 3333745 B2 7/2002

* cited by examiner

*Primary Examiner*—Gary Estremsky
(74) *Attorney, Agent, or Firm*—Sughrue Mion, PLLC

(57) ABSTRACT

A handle apparatus is provided to a door of a vehicle and inside the vehicle compartment. The handle apparatus includes a handle lever, a locking knob, and cover member. A latch mechanism is released and a door of a vehicle can be opened by operating the handle lever. The locking knob is movable between a lock position and an unlock position by moving a lock operational unit in a specific region. The door gets locked when the locking knob is in the lock position, and the door gets unlocked when the locking knob is in the unlock position. The cover member covers at least a rear region of the specific region in which the lock operational unit can move.

6 Claims, 10 Drawing Sheets

HANDLE APPARATUS FOR VEHICLE DOOR

BACKGROUND OF THE INVENTION

1) Field of the Invention

The present invention relates to a handle apparatus provided inside the vehicle compartment to open the door of the vehicle and lock or unlock the door.

2) Description of the Related Art

Handle apparatuses of vehicle doors usually has a handle lever and a locking knob. A latch mechanism is released and the door can be opened by operating (turning or pulling) the handle lever. The door can be locked by operating the locking knob in a specific direction and can be unlocked by operating the locking knob in another specific direction. When the door is locked, an operation on the handle lever is not conveyed to the latch mechanism so that the door can not be opened. On the contrary, when the door is unlocked, an operation on the handle lever is conveyed to the latch mechanism so that the door is opened.

Japanese Patent Publication No. 3333745 discloses a conventional handle apparatus. In this handle apparatus, a lock operational unit of a locking knob is disposed near on a base of a handle lever in neighboring manner, and they are rotatably born by a common supporting shaft member.

Generally the handle apparatus is provided in a front half of the door. Accordingly, there is a little risk that a passenger unconsciously touches the handle lever or operates the locking knob while the vehicle is running. The passenger can perform the opening/closing of the door or the locking of the door only by stretching his/her hand.

However, due to shocks, for example if the vehicle collides with an object, the passenger can move greatly in the vehicle compartment, and can happen to operate the handle apparatus and open the door or lock the door. If the door is opened while the vehicle is running, it can lead to an accident. On the other hand, it becomes difficult to open the door from outside, for example in an emergency, if the door is locked from inside.

SUMMARY OF THE INVENTION

It is an object of the present invention to solve at least the problems in the conventional technology.

A handle apparatus according to an aspect of the present invention is provided in a compartment of a vehicle to a door of the vehicle. The handle apparatus includes a handle lever that enables a releasing operation of a latch mechanism so as to allow the door to be opened; a locking knob movable between a lock position and an unlock position based on a movement of a lock operational unit is a specific region, the locking knob switching a locking mechanism to a lock state when in the lock position, thereby imposing a predetermined restriction on the releasing operation of the latch mechanism, while switching the locking mechanism to an unlock state when in the unlock position, thereby canceling the restriction on the releasing operation of the latch mechanism; and a cover member that covers at least a rear region of the specific region in which the lock operational unit can move.

The other objects, features, and advantages of the present invention are specifically set forth in or will become apparent from the following detailed description of the invention when read in conjunction with the accompanying drawings.

DETAILED DESCRIPTION

Exemplary embodiments of the present invention are explained below in detail while referring to the accompanying drawings.

Figure 5:
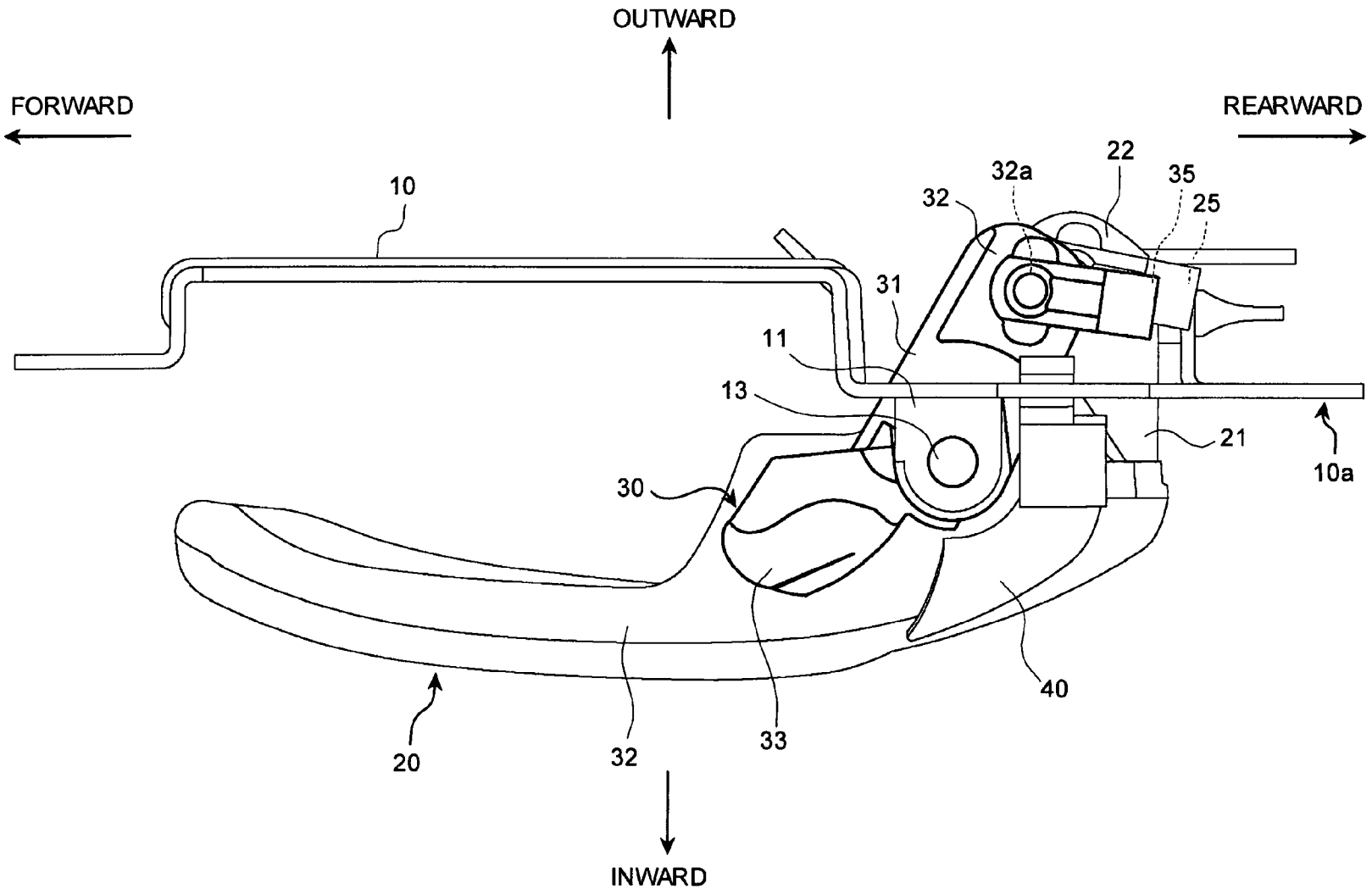
FIG. 5 is a plan view of the handle apparatus shown in FIG. 4.
Figure 6:
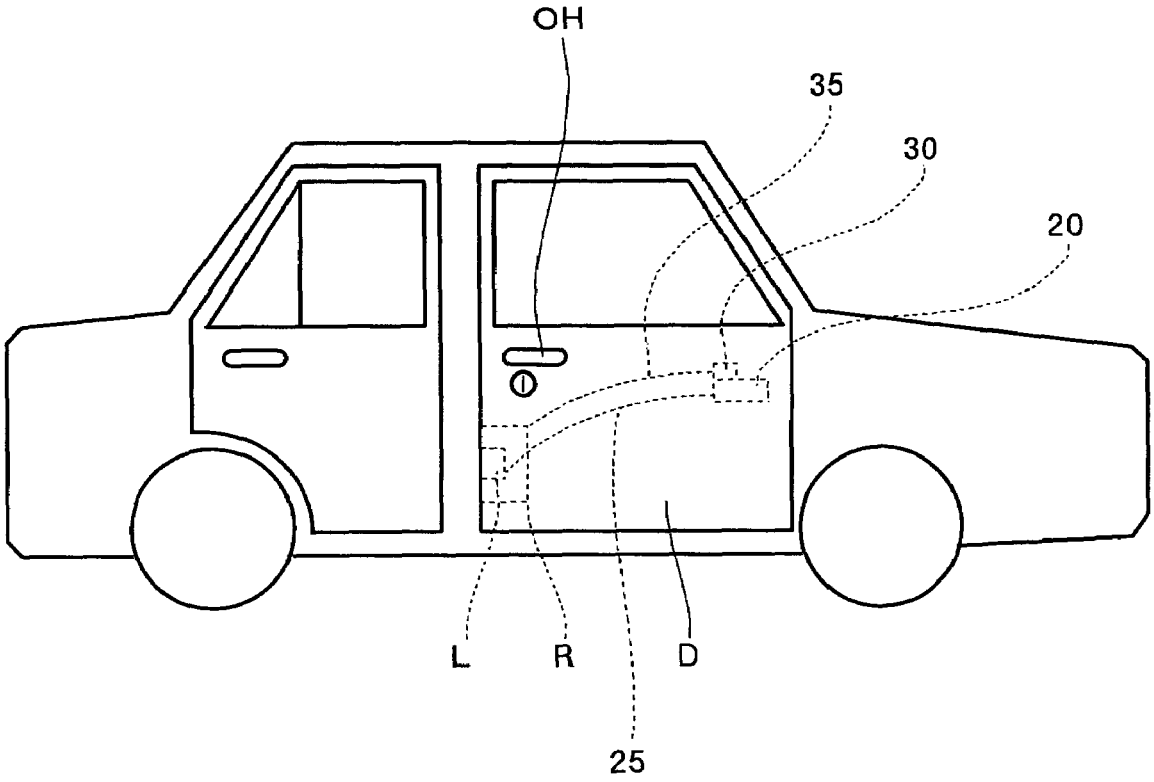
FIG. 6 is a schematic of a vehicle mounted with the handle apparatus shown in FIG. 1.
Figure 7:
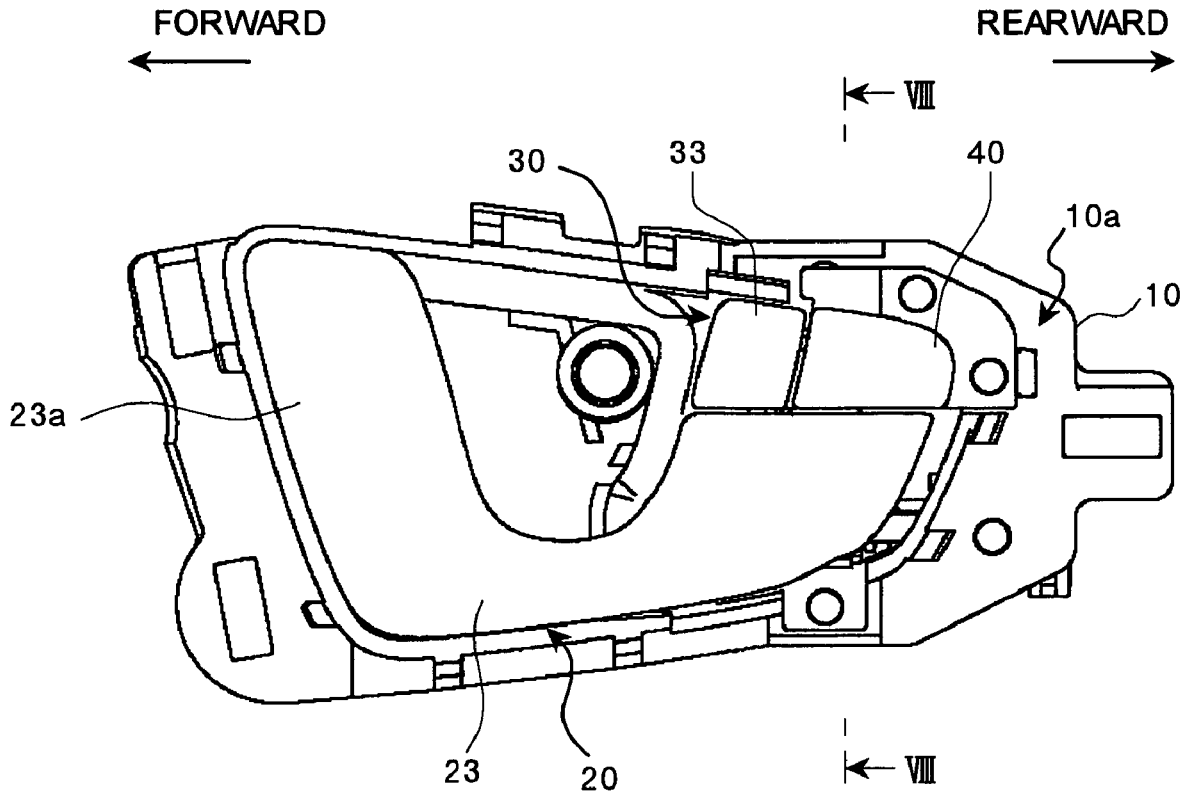
FIG. 7 is another embodiment of a handle apparatus.
Figure 8:
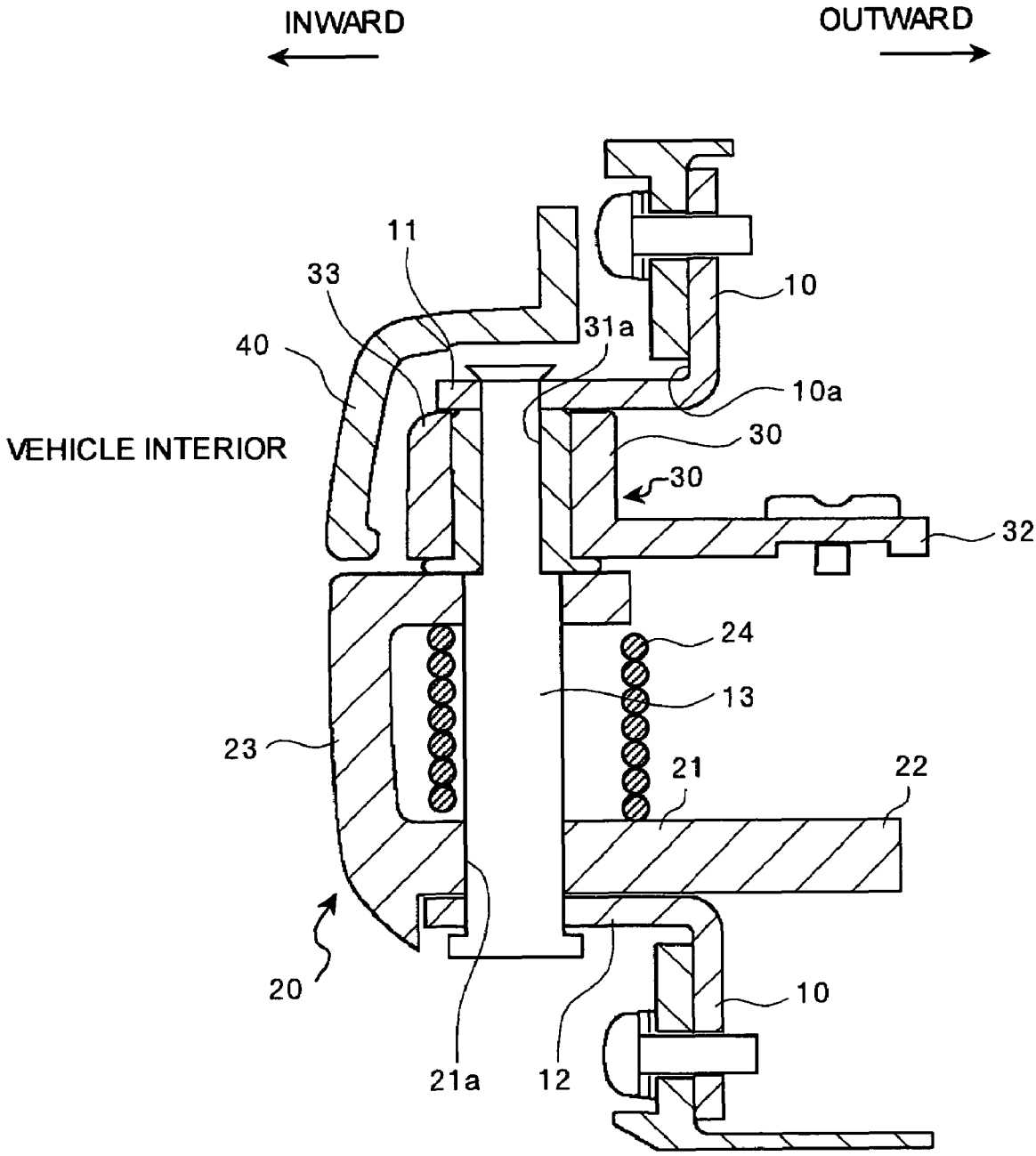
FIG. 8 is a cross section along the line VIII-VIII in FIG. 7.
Figure 9:
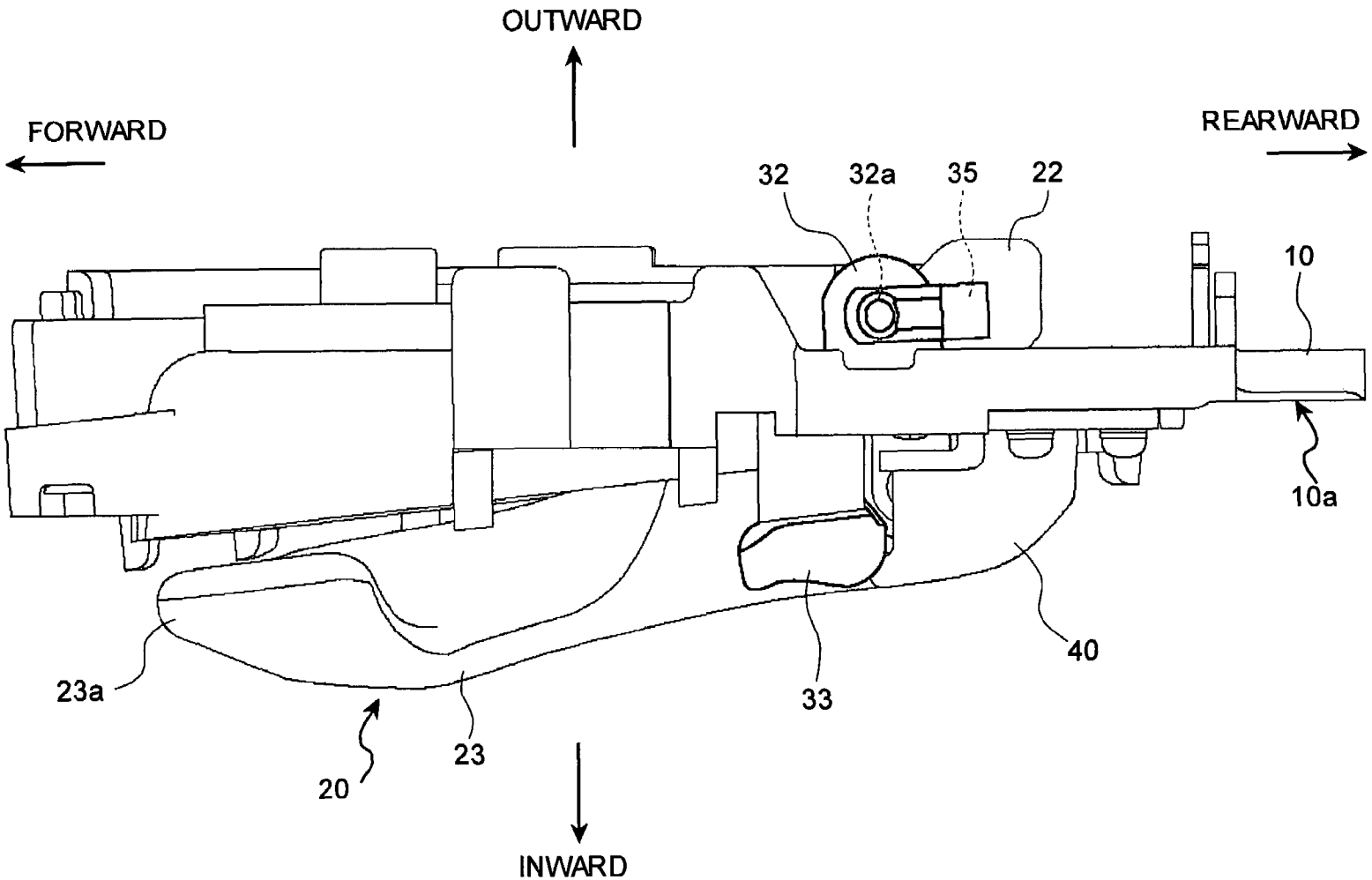
FIG. 9 is a plan view of the handle apparatus shown in FIG. 7.
Figure 10:
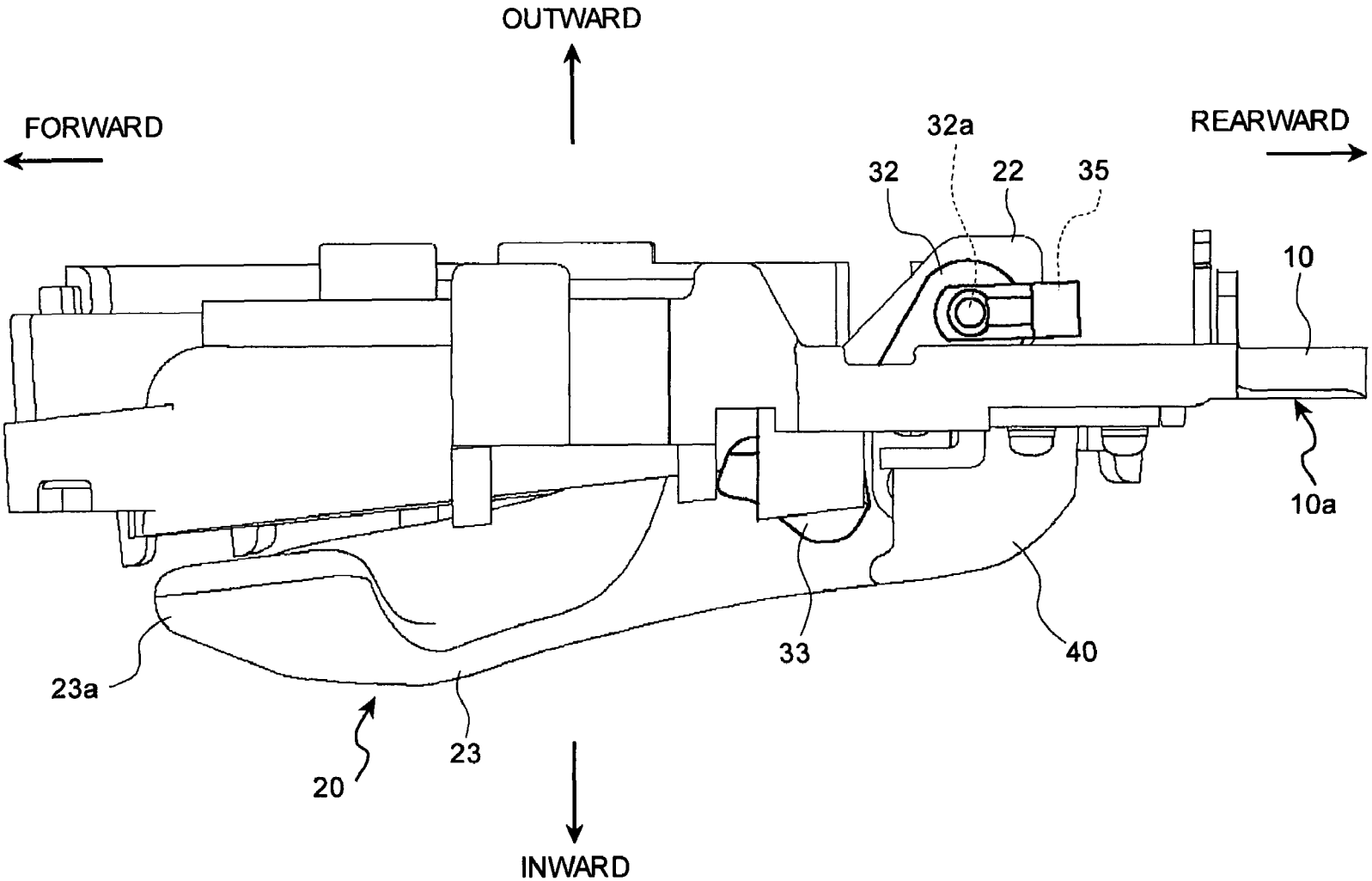
FIG. 10 is another plan view of the handle apparatus shown in FIG. 7.

FIGS. 1 to 5 depict a handle apparatus according to an embodiment of the present invention. The handle apparatus is provided in a side door of front hinge located on the right side of front seats of a vehicle as shown in FIG. 6 (door D of the driver's seat in a right-hand-drive car) and provided for operating a latch mechanism L and a locking mechanism R disposed in the door D from inside the vehicle interior. Detailed explanation for the latch mechanism L and the locking mechanism R will be omitted because they are well known in the art.

As shown in FIGS. 1 to 5, the handle apparatus has a handle base 10. The handle base 10 serves as a base for mounting the handle apparatus on an inner panel (not shown) of the door D, and is formed of a metal seat which is relatively thick and rigid. The handle base 10 is provided with a pair of upper and lower bearing brackets 11, 12. The bearing brackets 11, 12 protrude from a surface on the side of vehicle interior in the handle base 10 (hereinafter, "inner surface 10*a*") so as to oppose each other, and between the respective protruding ends is provided a supporting shaft member 13. The supporting shaft member 13 is attached between the bearing brackets 11, 12 along the up-and-down direction, and bears a handle lever 20 at its lower part and a locking knob 30 at its upper part.

Figure 1:
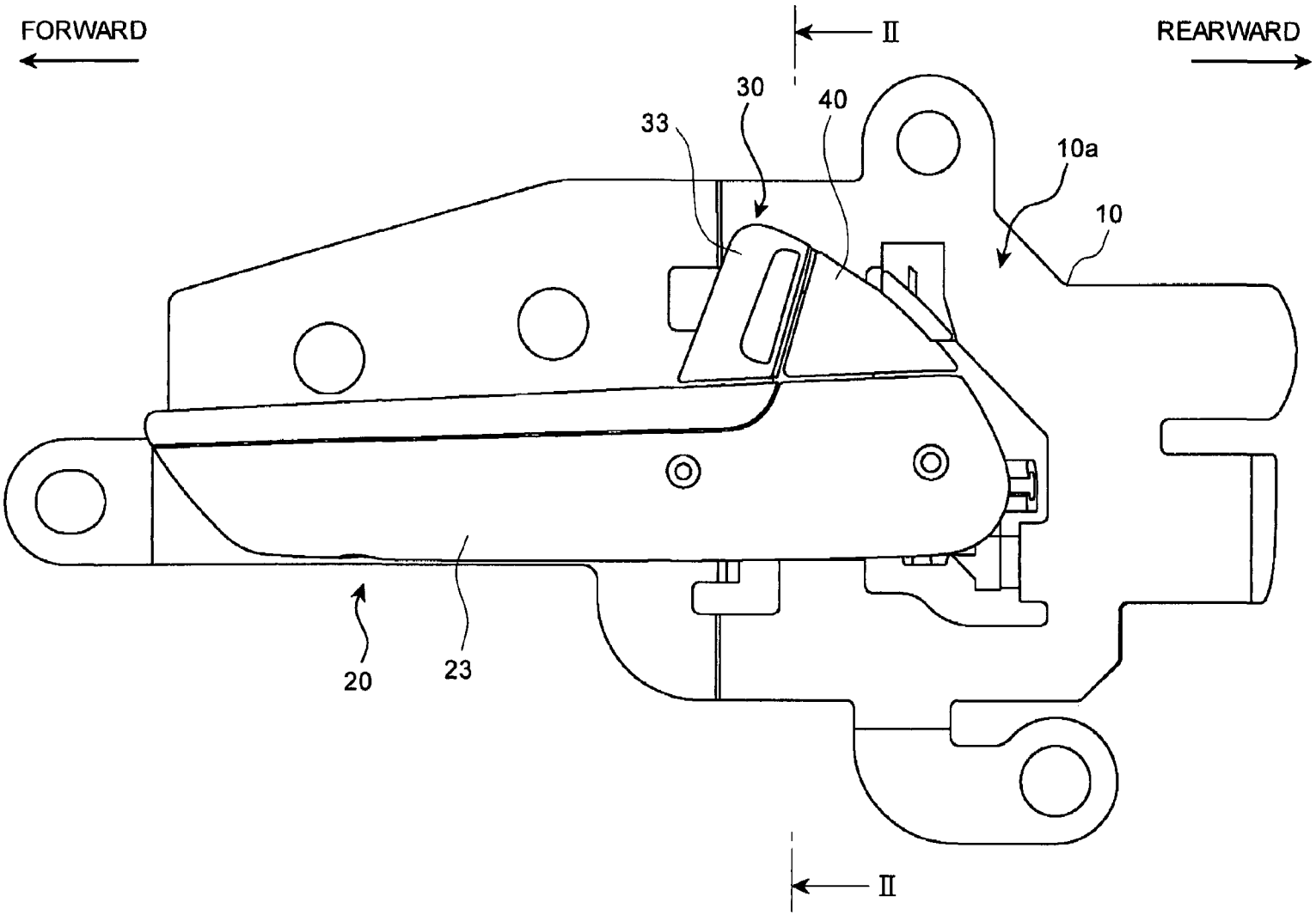
FIG. 1 is a side view of a handle apparatus according to an embodiment of the present invention.
Figure 2:
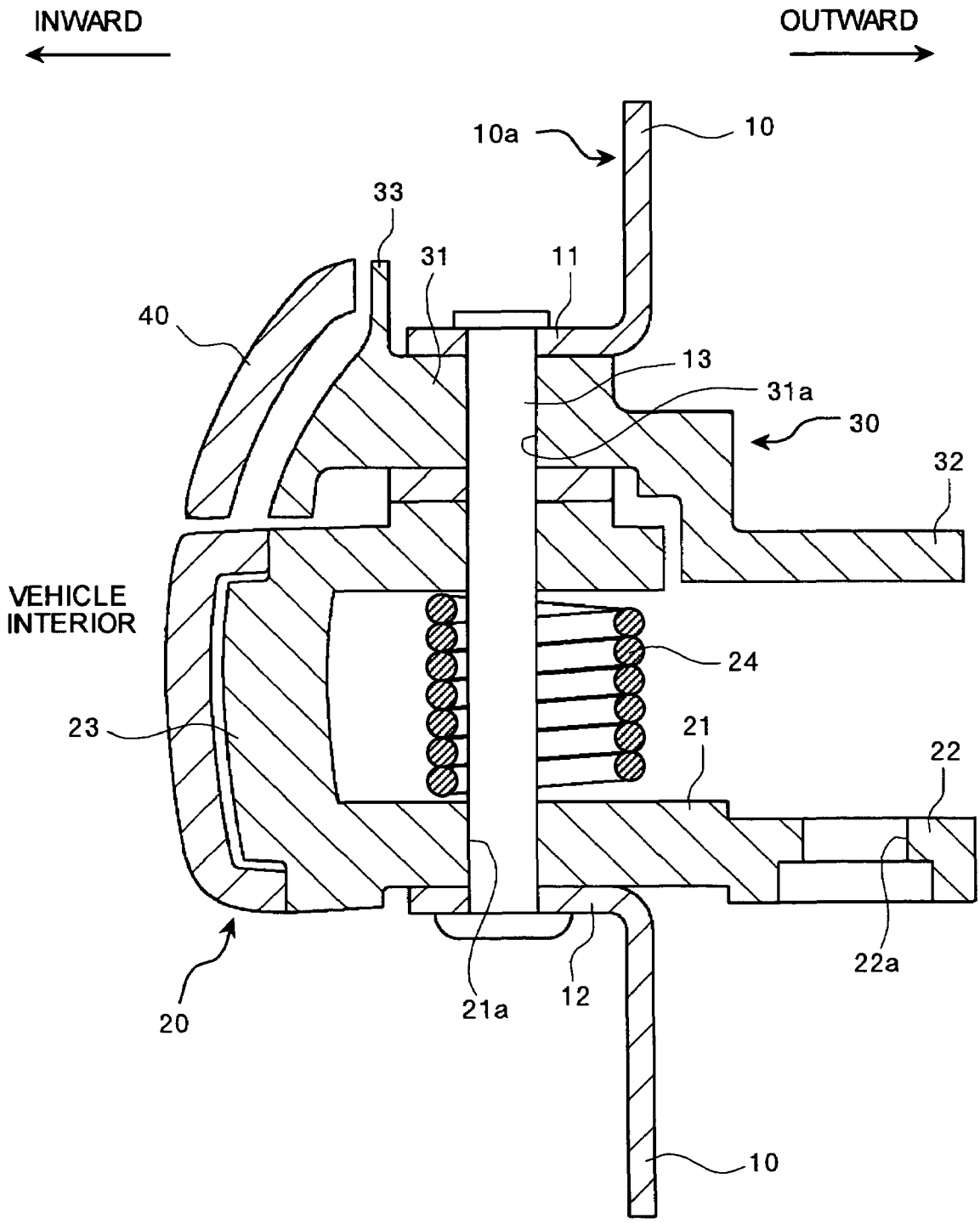
FIG. 2 is a cross section along the line II-II in FIG. 1.
Figure 3:
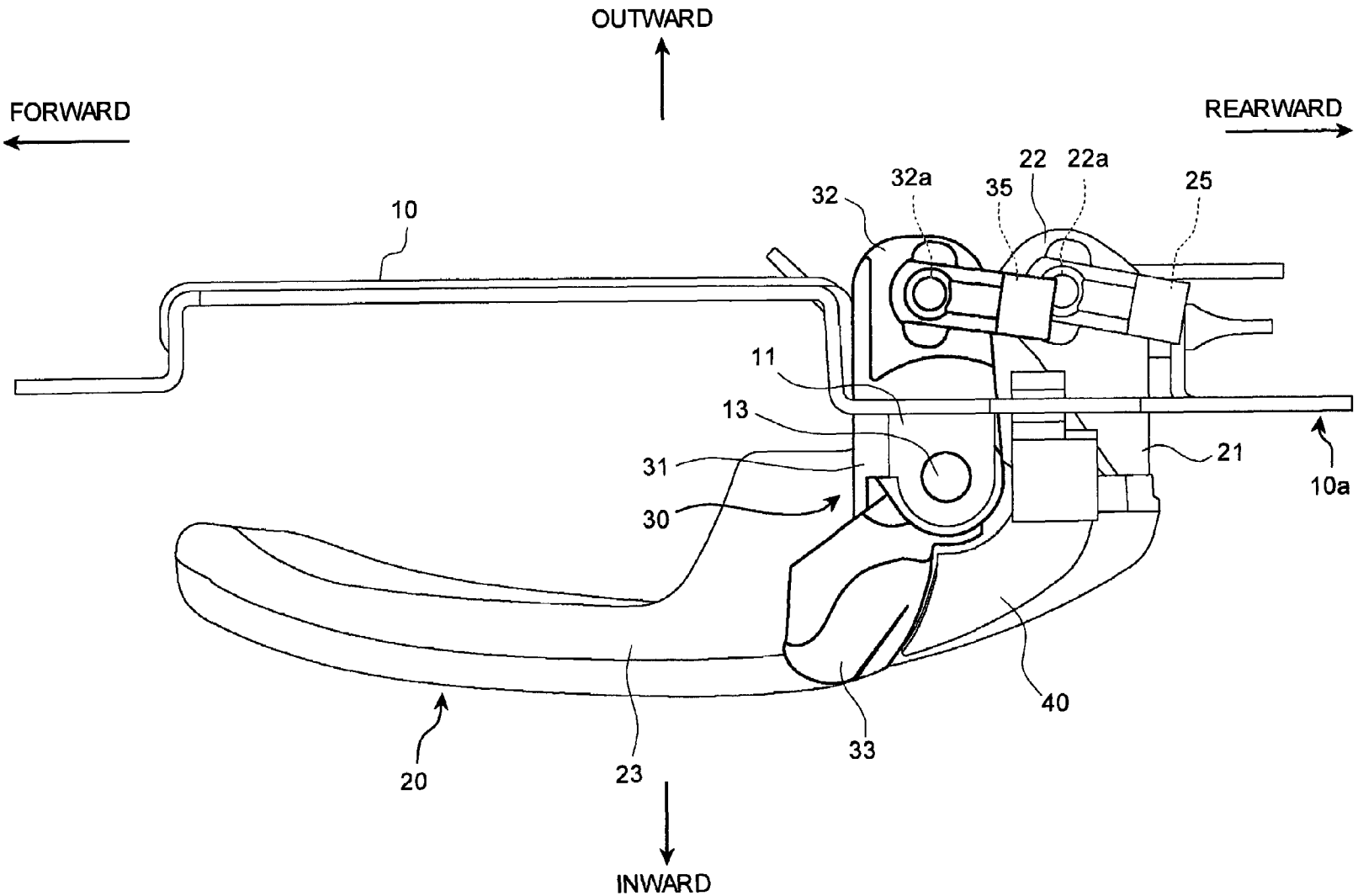
FIG. 3 is a plan view of the handle apparatus shown in FIG. 1.
Figure 4:
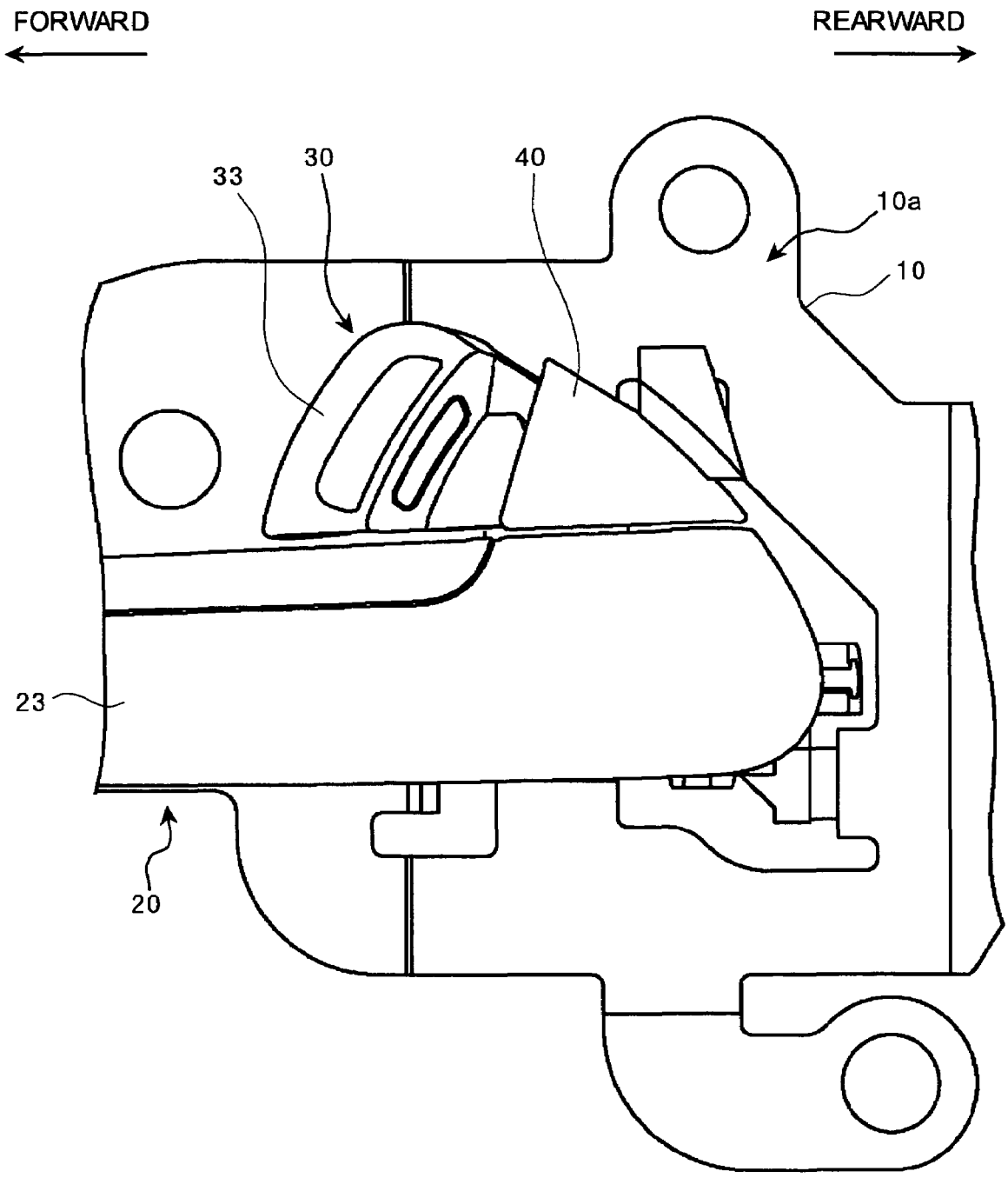
FIG. 4 is a side view of the handle apparatus of FIG. 1.

The handle lever 20 is rotatably disposed about the supporting shaft member 13 by letting the supporting shaft member 13 penetrate through a through hole 21*a* provided in a lever base 21, and has a lever link unit 22 and a lever operation unit 23. The lever link unit 22 extends in an outward radial direction from the supporting shaft member 13 in the outward direction of vehicle, and has an opening operation cable link hole 22*a* on its extension end. The lever operation unit 23 provided for a passenger to directly operate for opening the door D, first extends in the inward direction of vehicle from the supporting shaft member 13 and then extends in the forward direction of vehicle. More specifically, as shown in FIG. 3, the lever link unit 22 and the lever operation unit 23 are so configured that when the opening operation cable link hole 22*a* of the lever link unit 22 is disposed with respect to the handle base 10 diagonally at approximately 45° in the rearward direction of vehicle and in the inward direction of vehicle from the supporting shaft member 13, the extension end of the handle lever 20 is in a position directed in the forward direction of vehicle (hereinafter, "ordinary state of the handle lever 20").

The handle lever 20 is provided with a return spring 24 interposed between the lever base 21 and the handle base 10, and to the lever link unit 22 one end of an opening operation wire cable 25 is connected via the opening operation cable link hole 22*a*. The return spring 24 is provided between the lever base 21 and the handle base 10 so as to hold the handle lever 20 in ordinary state. The opening operation wire cable 25 transmits an operation force exerted on the handle lever 20 to a latch mechanism L and links between the lever link unit 22 and the latch mechanism L so that the latch mechanism L is released when the lever operation unit 23 of the handle lever 20 is swung in the inward direction of vehicle against an elastic force of the return spring 24. In brief, in the handle apparatus of the present embodiment, the latch mechanism L will be released when a pulling force is exerted via the opening operation wire cable 25 by an operation of the handle lever 20.

A locking knob 30 is rotatably disposed about the supporting shaft member 13 by letting the supporting shaft member 13 penetrate through a through hole 31*a* provided in a lock base 31, and has a lock link unit 32 and a lock operational unit 33. The lock link unit 32 extends in an outward radial direction from the supporting shaft member 13 in the outward direction of vehicle, and has an switching operation cable link hole 32*a* in its extension end. The lock operational unit 33 provided for a passenger to directly operate for switching the locking mechanism R between a lock state and an unlock state, extends in the inward direction of vehicle from the supporting shaft member 13. More specifically, as shown in FIG. 3, the lock link unit 32 and the lock operational unit 33 are so configured that when the switching operation cable link hole 32*a* of the lock link unit 32 is disposed with respect to the handle base 10 at approximately 90° in the outward direction of vehicle from the supporting shaft member 13, the lock operational unit 33 is in a position of approximately 45° in the rearward direction of vehicle and in the inward direction of vehicle (hereinafter, "lock position").

In the locking knob 30, one end of the switching operation wire cable 35 is connected to the lock link unit 32 via the switching operation cable link hole 32*a*. The switching operation wire cable 35 transmits an operation force exerted on the locking knob 30 to the locking mechanism R and links the lock link unit 32 and the locking mechanism R in such a manner that when shifted to a lock position, the locking mechanism R is shifted to a lock state, while as shown in FIG. 5, when the lock operational unit 33 is rotated by 45° in the forward direction of vehicle about the axial center of the supporting shaft member 13 (hereinafter, "unlock position"), the locking mechanism R is shifted to an unlock state. In brief, the handle apparatus of the present embodiment is so configured that when a pulling force is exerted via the switching operation wire cable 35 by an operation of the locking knob 30, the locking mechanism R is shifted to a lock state, and when a pushing force is exerted via the switching operation wire cable 35, the locking mechanism R is shifted to an unlock state. As is apparent from FIGS. 3 and 5, protruding amounts into the inward direction of vehicle of the lock operational unit 33 in the locking knob 30 are nearly equal to the protruding amount of the lever operation unit 23 in the handle lever 20, and when the lock operational unit 33 of the locking knob 30 shifts from a lock position to an unlock position, the protruding amounts in the inward direction of vehicle will gradually reduce.

On the other hand, the handle apparatus is provided with a cover member 40. The cover member 40 is fixed at a position rearward from the lock operational unit 33 of the locking knob 30 in the handle base 10, and protrudes in the inward direction of vehicle from the handle base 10. This cover member 40 is adjacent to the lock operational unit 33 and covers a rear region thereof when the locking knob 30 is in a lock position.

The handle apparatus constituted as described above is arranged in the front part of the door D as is the same with the conventional one, and there is no risk that a passenger will unconsciously touch the handle lever 20 or the lock operational unit 33 of the locking knob 30 during usual drive. A passenger can operate them for opening the door D or switching the locking mechanism R only when he/she extends his/her arm. In this case, if the locking mechanism R is shifted to a lock state via the lock operational unit 33, a releasing operation of the latch mechanism L is restricted, and for example, a door-opening operation of an outside handle OH (see FIG. 6) will not be transmitted to the latch mechanism L so that the door D is kept in a closed state. If the locking mechanism R is shifted to an unlock state via the lock operational unit 33, a door-opening operation of an outside handle OH will be transmitted to the latch mechanism L so that the door D can be opened relative to the vehicle body.

According to the present handle apparatus, since the cover member 40 is provided that covers a rear region of a moving region of the lock operational unit 33, even if passengers are largely moved due to exertion of an impact such as collision to the vehicle, the situation that a passenger erroneously touches the lock operation unit 33 of the locking know 30 is significantly reduced. Regardless of whether a hand of a passenger moves in the forward direction of the vehicle or in the rearward direction of the vehicle to touch the inside lock apparatus, the cover member 40 prevents the hand from touching the lock operational unit 33, which eliminates the risk that the locking mechanism R is unconsciously switched. As a result, when the locking mechanism R is in an unlock state, the locking mechanism R will continuously keep the unlock state even when an impact such as collision is exerted on the vehicle, so that the door D can be readily opened from outside.

Furthermore, according to the handle apparatus, through an operation of the locking knob 30, when a pulling force is exerted via the switching operation wire cable 35, the locking mechanism R is shifted to a lock state, while when a pushing force is exerted via the switching operation wire cable 35, the locking mechanism R is shifted to an unlock state. This is advantageous in respect of antitheft ability. That is, when someone bearing malice pulls or pushes an intermediate portion of the switching operation wire cable 35 through a gap using a tool or the like, a pulling force is exerted on the locking mechanism R, so that the lock state will not shift to an unlock state, making it difficult to open the door D.

In the embodiment, explanation was given while taking a handle apparatus provided in a side door D of front hinge located on the right of front seats of a four-wheeled vehicle. As for a door D on the left of the front seats, a handle apparatus having a shape symmetrical to that of the embodiment may be applied.

In the embodiment, the lever operation unit 23 of the handle lever 20 extending linearly is exemplified; however, the shape of the handle lever 20 is not necessarily limited thereto. For example, in an embodiment shown in FIGS. 7 to 10, a handle apparatus in which an extension end 23*a* of the lever operation unit 23 has an upwardly curved shape is exemplified. In this embodiment, constitution of the locking knob 30 is as same as that of the embodiment and an equivalent operation and effect can be achieved. In the modified embodiment shown in FIGS. 7 to 10, a similar constituent to that in the embodiment is denoted by a similar reference numeral.

According to the present invention, since a cover member is provided so as to cover at least a rear region in a moving region of the lock operational unit, even if a passenger moves largely due to shocks or impacts, for example, due to collision to the vehicle, chances of the passenger accidentally touching the lock operation unit are significantly reduced.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. A handle apparatus provided in a compartment of a vehicle to a door of the vehicle, comprising:

a handle lever that enables a releasing operation of a latch mechanism so as to allow the door to be opened;

a locking knob that is movable between a lock position and an unlock position and comprises a lock operational unit that is disposed in a specific region, said lock operational unit being manually rotatable in a first direction to an unlocked position and in a second direction to a locked position wherein the locking knob is operative for switching a locking mechanism to a lock state when in the lock position, thereby imposing a predetermined restriction on the releasing operation of the latch mechanism, while switching the locking mechanism to an unlock state when in the unlock position, thereby canceling the restriction on the releasing operation of the latch mechanism; and a cover member that covers at least a rear region of said specific region in which the lock operational unit can move, wherein when the locking knob is in the lock position, the lock operational unit is located adjacent to the cover member, and when the locking knob is moved to the unlock position in such a manner that the lock operational unit separates from the cover member, a protruding amount of the lock operational unit into the vehicle interior is gradually reduced.

2. The handle apparatus according to claim 1, wherein the locking knob is linked with the locking mechanism via a wire cable, and makes the wire cable to be pushed with respect to the locking mechanism when moved from the lock position to the unlock position.

3. A handle apparatus provided in a compartment of a vehicle to a door of the vehicle, comprising:

a handle lever that enables a releasing operation of a latch mechanism so as to allow the door to be opened;

a locking knob that is movable between a lock position and an unlock position and comprises a lock operational unit that is disposed in a specific region, said lock operational unit being manually rotatable in a first direction to an unlocked position and in a second direction to a locked position wherein the locking knob is operative for switching a locking mechanism to a lock state when in the lock position, thereby imposing a predetermined restriction on the releasing operation of the latch mechanism, while switching the locking mechanism to an unlock state when in the unlock position, thereby canceling the restriction on the releasing operation of the latch mechanism; and a cover member that covers at least a rear region of said specific region in which the lock operational unit can move, wherein the lock operational unit is located adjacent to the cover member and has a first protruding amount into the vehicle interior when the locking knob is in the lock position, the lock operational unit separates from the cover member when the lock operational unit is operated in such a manner that the looking knob is moved to the unlock position, and the cover member has a second protruding amount into the vehicle interior, wherein the lock operational unit has a third protruding amount which is smaller than the first protruding amount when the locking knob is in the unlock position.

4. The handle apparatus according to claim 3, wherein the second protruding amount is substantially equal to the first protruding amount.

5. The handle apparatus according to claim 4, wherein the first protruding amount is gradually reduced to the third protruding amount when the lock operational unit is operated in such a manner that the locking knob is moved from the lock position to the unlock position.

6. The handle apparatus according to claim 3, wherein the locking knob is linked with the locking mechanism via a wire cable, and makes the wire cable to be pushed with respect to the locking mechanism when moved from the look position to the unlock position.

* * * * *